US008890754B2

(12) United States Patent
Lin et al.

(10) Patent No.: US 8,890,754 B2
(45) Date of Patent: Nov. 18, 2014

(54) ANTENNA APPARATUS INTEGRATING METAL SHELL

(71) Applicants: Yen-Hui Lin, New Taipei (TW); Chien-Chang Liu, New Taipei (TW)

(72) Inventors: Yen-Hui Lin, New Taipei (TW); Chien-Chang Liu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 106 days.

(21) Appl. No.: 13/689,784

(22) Filed: Nov. 30, 2012

(65) Prior Publication Data

US 2014/0055304 A1 Feb. 27, 2014

(30) Foreign Application Priority Data

Aug. 27, 2012 (TW) ..... 101131082

(51) Int. Cl.
*H01Q 1/24* (2006.01)

(52) U.S. Cl.
CPC ..... *H01Q 1/24* (2013.01)
USPC ..... 343/702; 343/700 MS

(58) Field of Classification Search
USPC ..... 343/700 MS, 702
See application file for complete search history.

(56) References Cited

U.S. PATENT DOCUMENTS

| | | | | |
|---|---|---|---|---|
| 6,819,287 | B2 * | 11/2004 | Sullivan et al. | 343/700 MS |
| 2013/0207862 | A1 * | 8/2013 | Farooq et al. | 343/767 |
| 2014/0191908 | A1 * | 7/2014 | Lin | 343/702 |

* cited by examiner

*Primary Examiner* — Tan Ho
(74) *Attorney, Agent, or Firm* — Novak Druce Connolly Bove + Quigg LLP

(57) ABSTRACT

An antenna apparatus includes a metal shell, a circuit board parallel to the metal shell which forms a space between the circuit board and the shell, a tunable matching circuit mounted in the space with an terminal electrically connected to the shell, and an capacitive feed coupling antenna mounted on the circuit board. The capacitive feed coupling antenna includes a coupling ground strip mounted on the circuit board and a feed strip. The feed strip includes a first portion and a second portion mounted on the circuit board with a portion extending along an edge of the circuit board. The first portion is electrically interconnected between the other terminal of the tunable matching circuit and the second portion.

5 Claims, 2 Drawing Sheets

ANTENNA APPARATUS INTEGRATING METAL SHELL

BACKGROUND

1. Technical Field

The present disclosure relates to antennas, and particular to an antenna apparatus integrating a metal shell of an electronic device employing the antenna apparatus.

2. Description of the Related Art

Electronic devices commonly employ metal shells to cover and accommodate circuit boards and antennas. The metal shell usually generates shield which reduces efficiency of the antenna. Therefore, the electronic device has to be more complicatedly installed to avoid the shield generated by the metal shell, which will increase cost. Furthermore, sometimes there is not enough space for allocating the metal shell and the antenna due to the electronic device.

Therefore, there is room for improvement within the art.

BRIEF DESCRIPTION OF THE DRAWINGS

The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
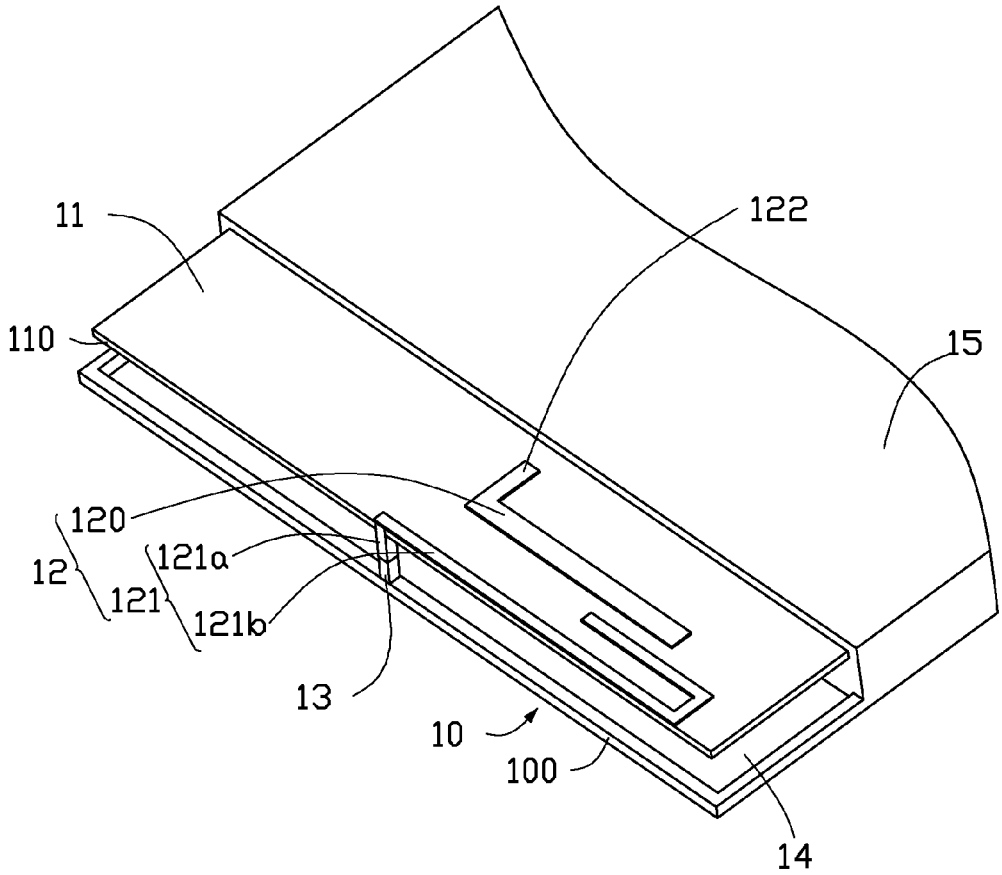
FIG. 1 is a partially sectioned schematic view of an antenna apparatus, according to an exemplary embodiment.

Referring to FIG. 1, an antenna apparatus 1 includes a metal shell 10 of an electronic device (not shown), a circuit board 11, an capacitive feed coupling antenna 12, and a tunable matching circuit 13. The metal shell 10 includes a continuous bent metal strip 100, and configured for attaching to a housing 15 of the electronic device to form a loop. The circuit board is mounted in the electronic device and parallel to the metal shell 10, keeping a distance away from the shell 10 to form a space 14 between the circuit board 11 and the shell 10. In the embodiment, the metal shell 10 is generally C-shaped.

The capacitive feed coupling antenna 12 is conductive and formed by a bended strip metal. The capacitive feed coupling antenna 12 includes a coupling ground strip 120, a feed strip 121, and a feed point 122. The coupling ground strip 120 is mounted on the circuit board 11. The feed strip 121 includes a first portion 121*a* and a second portion 121*b*. The first portion 121*a* and the tunable matching circuit 13 are mounted in the space 14. In detail, one terminal of the tunable matching circuit 13 is mounted on the shell 10, and the other terminal of the tunable matching circuit 13 is connected to an end of the first portion 121*a*. The other end of the first portion 121*a* is connected to the second portion 121*b*, and perpendicular to the circuit board 11. The second portion 121*b* is mounted on the circuit board 11 with a portion extending along an edge 110 of the circuit board. Thereby, the shell 10 is integrated with the capacitive feed coupling antenna 12, forming a double mimicry loop. The frequency band of the antenna apparatus 1 can be adjusted by changing parameters of the tunable matching circuit 13 or the capacitive feed coupling antenna 12.

Figure 2:
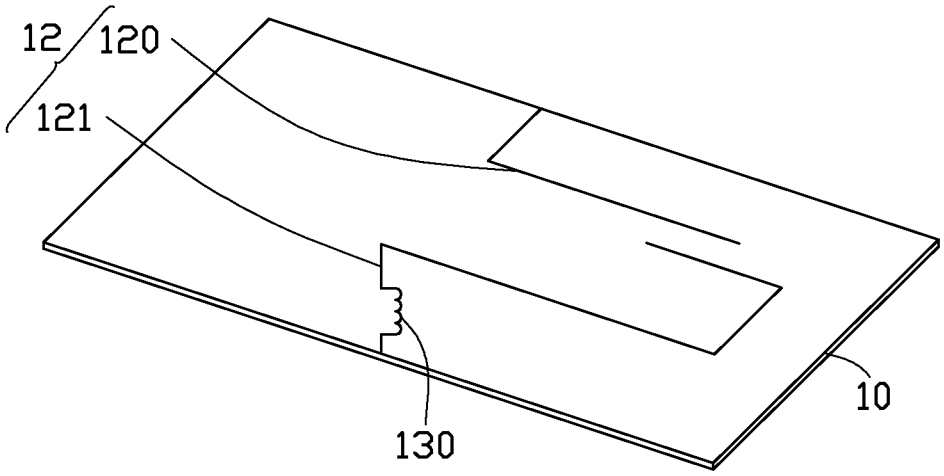
FIG. 2 is a schematic view of showing distribution of the antenna apparatus of FIG. 1.

Referring to FIG. 2, in the embodiment, the tunable matching circuit 13 includes an inductance 130, the first portion 121*a* of the feed strip 121 is connected to the shell 10 via the inductance 130. In an alternative embodiment, the tunable matching circuit 13 includes a capacitor, or a capacitor and an inductance.

It is understood that the present disclosure may be embodied in other forms without departing from the spirit thereof. The present examples and embodiments are to be considered in all respects as illustrative and not restrictive, and the disclosure is not to be limited to the details given herein.

What is claimed is:

1. An antenna apparatus comprising:

a metal shell comprising a continuous bent metal strip configured for attachment to a housing of an electronic device to form a loop;

a circuit board parallel to the metal shell, a space formed between the circuit board and the metal shell;

a tunable matching circuit mounted in the space with an terminal thereof electrically connected to the metal shell; and a capacitive feed coupling antenna formed on the circuit board, the capacitive feed coupling antenna comprising a coupling ground strip mounted on the circuit board and a feed strip, wherein the coupling ground strip comprising a first portion perpendicular to the circuit board and a second portion mounted on the circuit board with a portion extending along an edge of the circuit board, the first portion electrically interconnected between the other terminal of the tunable matching circuit and the second portion.

2. The antenna apparatus as recited in claim 1, wherein the metal shell is generally C-shaped.

3. The antenna apparatus as recited in claim 1, wherein the first portion of the feed strip is perpendicular to the circuit board.

4. The antenna apparatus as recited in claim 1, wherein the tunable matching circuit comprises an inductance, the coupling ground strip is connected to the shell via the inductance.

5. The antenna apparatus as recited in claim 1, wherein the tunable matching circuit comprises a capacitor, the coupling ground strip is connected to the shell via the capacitor.

* * * * *